US006471216B1

(12) United States Patent
Brainch et al.

(10) Patent No.: US 6,471,216 B1
(45) Date of Patent: Oct. 29, 2002

(54) ROTATING SEAL

(75) Inventors: Gulcharan S. Brainch, West Chester, OH (US); John C. Brauer, Lawrenceburg, IN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/317,244

(22) Filed: May 24, 1999

(51) Int. Cl.[7] ..... F16J 15/447
(52) U.S. Cl. ..... 277/418
(58) Field of Search ..... 277/414, 415, 277/418, 407, 559

(56) References Cited

U.S. PATENT DOCUMENTS 3,085,809 A * 4/1963 Cooper
3,411,794 A 11/1968 Allen
3,719,365 A 3/1973 Emmerson et al.
3,834,001 A 9/1974 Carroll et al. ..... 29/414
3,838,862 A * 10/1974 Fern
3,913,925 A * 10/1975 Gyory
4,392,656 A * 7/1983 Tirole et al.
4,513,975 A * 4/1985 Hauser et al.
4,596,394 A * 6/1986 Schmitt
4,668,163 A 5/1987 Kervistin ..... 415/116
4,820,119 A * 4/1989 Joyce
5,314,304 A * 5/1994 Wiebe
5,547,340 A 8/1996 Dalton et al. ..... 415/121.2
5,749,701 A 5/1998 Clarke et al. ..... 415/115
5,951,892 A * 9/1999 Wolfla et al.
6,203,021 B1 * 3/2001 Wolfla et al.

* cited by examiner

*Primary Examiner*—Anthony Knight
*Assistant Examiner*—Michael W White
(74) *Attorney, Agent, or Firm*—William Scott Andes; Pierce Atwood

(57) ABSTRACT

Overall performance in enhanced in gas turbine engines by providing a rotating seal including a rotating member arranged to rotate about an axis and having at least one annular projection extending radially outwardly therefrom, and a stator element having a first surface arranged to contact the projection. The stator element includes at least one slot formed in the first surface, the slot axially traversing the projection so as to allow a flow of purge air to pass. More than one such slot can be used, and each slot is preferably angled circumferentially in the direction of rotation of the rotating member.

9 Claims, 6 Drawing Sheets

ROTATING SEAL

BACKGROUND OF THE INVENTION

This invention relates generally to rotating seals and more particularly to a rotating seal for use as the forward outer seal of a gas turbine engine.

A gas turbine engine includes a compressor that provides pressurized air to a combustor wherein the air is mixed with fuel and ignited for generating hot combustion gases. These gases flow downstream to one or more turbines that extract energy therefrom to power the compressor and provide useful work such as powering an aircraft in flight. Aircraft engines ordinarily include a stationary turbine nozzle disposed at the outlet of the combustor for channeling combustion gases into the first stage turbine rotor disposed downstream thereof. The turbine nozzle directs the combustion gases in such a manner that the turbine blades can do work.

Typically, a forward outer seal is provided between the stationary turbine nozzle and the first stage turbine rotor for sealing the compressor discharge air that is bled off for cooling purposes from the hot gases in the turbine flow path. However, in most high pressure turbines, the forward outer seal requires use of a number of by-pass holes which permit a flow of cooling air into the forward wheel cavity between the turbine nozzle and the first stage turbine rotor. This air purges the forward wheel cavity to ensure against hot gas ingestion. A failure to maintain adequate purge flow can lead to significantly reduced part life of adjacent components.

Conventional forward outer seals comprise a rotating labyrinth seal made up of a rotating seal element and a static seal element. The rotating element has a number of thin, tooth-like projections extending radially from a relatively thicker base toward the static element. The static element is normally of a honeycomb material. These seal elements are generally situated circumferentially about the longitudinal centerline axis of the engine and are positioned with a small radial gap therebetween to permit assembly of the various components. When the gas turbine engine is operated, the rotating element expands radially and rubs into the static element, thereby creating the seal. During new engine operation, the labyrinth seal experiences little or no leakage. Thus, by-pass holes are required to ensure adequate purge flow into the forward wheel cavity. Over time, however, continued operation of the engine will result in gradual deterioration of the seal elements. This means that more cooling air will leak through the labyrinth seal into the forward wheel cavity and supplement the purge flow through the by-pass holes. Eventually, the amount of air leaking through the labyrinth seal will be sufficient to purge the forward wheel cavity, reducing, or even eliminating, the need for the by-pass holes. But because of the presence of the by-pass holes, which are necessary during new engine operation, the wheel cavity purge flow is greater than necessary, which is detrimental to overall engine performance.

Accordingly, there is a need for a turbine forward outer seal that provides adequate purge of the forward wheel cavity during initial engine start up and reduces the level of by-pass air as the seal deteriorates.

SUMMARY OF THE INVENTION

The above-mentioned needs are met by the present invention which provides a rotating seal including a rotating member arranged to rotate about an axis and having at least one annular projection extending radially outwardly therefrom, and a stator element having a first surface arranged to contact the projection. The stator element includes at least one slot formed in the first surface, the slot axially traversing the projection so as to allow a flow of purge air to pass. More than one such slot can be used, and each slot is preferably angled circumferentially in the direction of rotation of the rotating member.

When utilized as the forward outer seal in a gas turbine engine, the rotating seal of the present invention eliminates the need for conventional by-pass holes, and by better matching the amount of purge flow to the engine's forward wheel cavity to the seal deterioration, the present invention improves engine performance over a longer period of operation.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
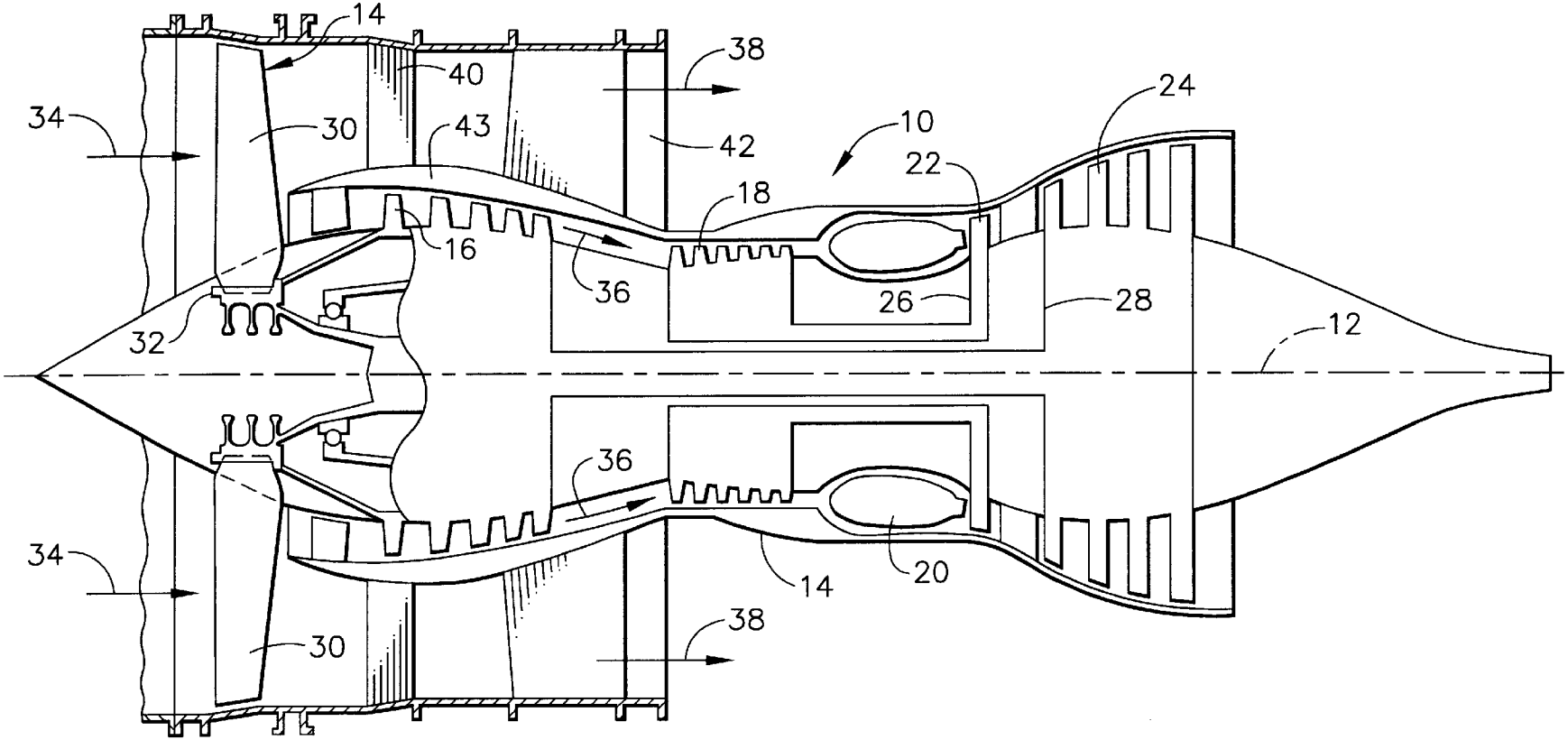
FIG. 1 is a longitudinal cross-sectional view of an exemplary turbofan gas turbine engine having the forward outer seal of the present invention.

Referring to the drawings wherein identical reference numerals denote the same elements throughout the various views, FIG. 1 shows an exemplary turbofan gas turbine engine 10. While it is recognized that turbofan engines in general are well known in the art, a brief description of the overall configuration of the engine 10 and the interrelationship of its various components will enhance understanding of the invention to be described below. Furthermore, it should be pointed out that a turbofan engine is used only as an example; the rotating seal of the present invention can be used with any type of gas turbine engine and is not limited to turbofan engines. Indeed, the present invention can be used in any application where seals are needed between relatively moving components.

The engine 10 includes, in serial axial flow communication about a longitudinal centerline axis 12, a fan 14, booster 16, high pressure compressor 18, combustor 20, high pressure turbine 22, and low pressure turbine 24. The high pressure turbine 22 is drivingly connected to the high pressure compressor 18 with a first rotor shaft 26, and the low pressure. turbine 24 is drivingly connected to both the booster 16 and the fan 14 with a second rotor shaft 28. The fan 14 comprises a plurality of radially extending fan blades 30 mounted on an annular disk 32, wherein the disk 32 and the blades 30 are rotatable about the longitudinal centerline axis 12 of engine 10.

During operation of engine 10, ambient air 34 enters the engine inlet and a first portion of the ambient air 34, denoted the primary gas stream 36, passes through the fan 14, booster 16 and high pressure compressor 18, being pressurized by each component in succession. The primary gas stream 36 then enters the combustor 20 where the pressurized air is mixed with fuel and burned to provide a high energy stream of hot combustion gases. The high energy gas stream passes through the high pressure turbine 22 where it is expanded, with energy extracted to drive the high pressure compressor 18, and then the low pressure turbine 24 where it is further expanded, with energy being extracted to drive the fan 14 and the booster 16. A second portion of the ambient air 34, denoted the secondary or bypass airflow 38, passes through the fan 14 and the fan outlet guide vanes 40 before exiting the engine through an annular duct 42, wherein the secondary airflow 38 provides a significant portion of the engine thrust.

Figure 2:
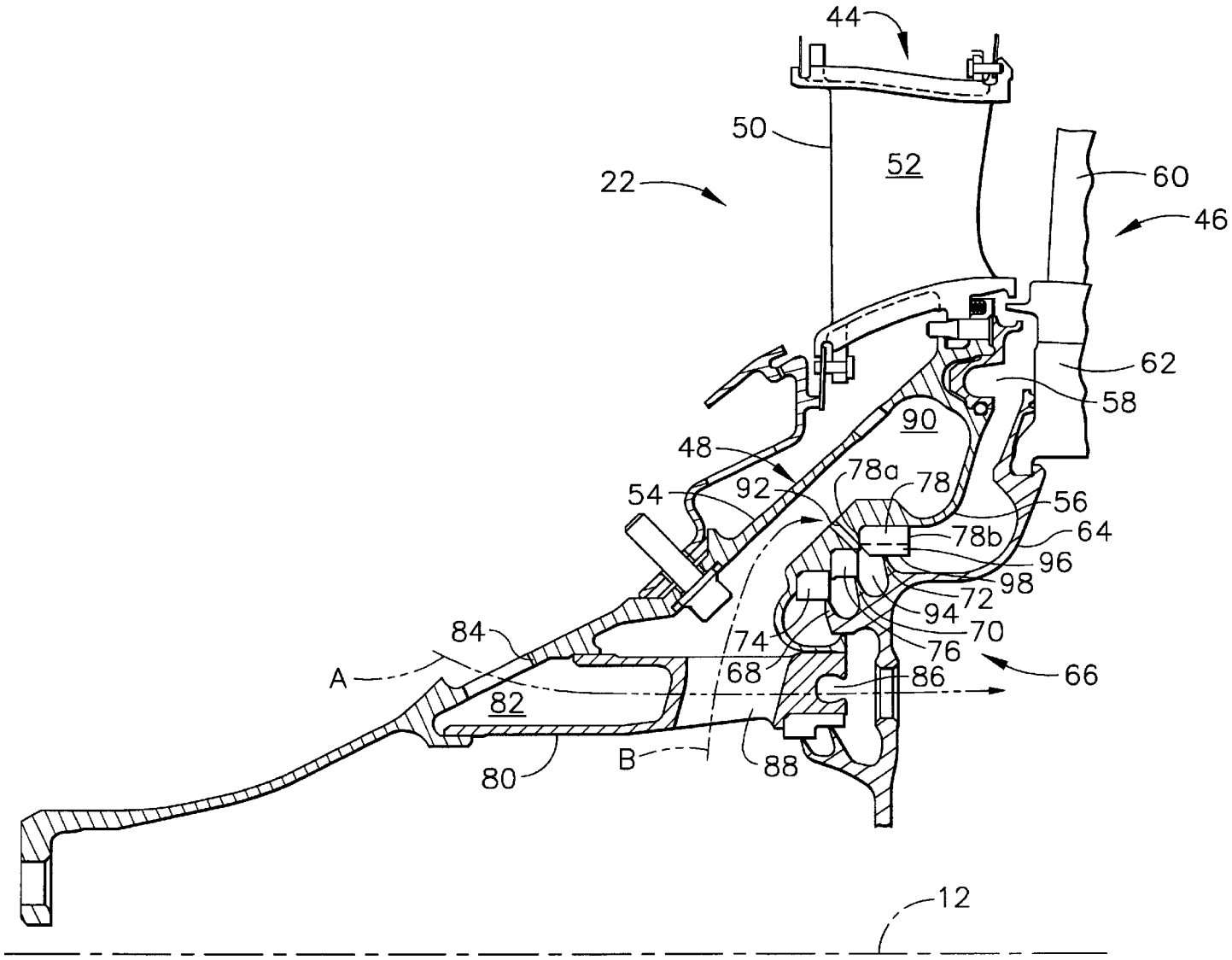
FIG. 2 is a partial cross-sectional view of the high pressure turbine section of the gas turbine engine of FIG. 1.

Referring now to FIG. 2, there is shown a partial view of the high pressure turbine 22. The high pressure turbine 22 includes a turbine nozzle assembly 44 and a first stage turbine rotor 46. The turbine nozzle assembly 44 includes an inner nozzle support 48 to which a plurality of circumferentially adjoining nozzle segments 50 is mounted. The nozzle segments 50 collectively form a complete 360° assembly. Each segment 50 has two or more circumferentially spaced vanes 52 (one shown in FIG. 2) over which the combustion gases flow. The vanes 52 are configured so as to optimally direct the combustion gases to the first stage turbine rotor 46. The inner nozzle support 48 is a stationary member suitably supported in the engine 10 and includes a substantially conical portion 54. The nozzle segments 50 are mounted to the axially and radially distal end of the conical portion 54. The turbine nozzle assembly 44 also includes an annular stationary seal member 56. As shown in FIG. 2, the stationary seal member 56 is integrally formed to the axially and radially distal end of the conical portion 54 and extends radially inwardly. However, the stationary seal member 56 could alternatively be a separate piece that is fixedly fastened to the conical portion 54.

The first stage turbine rotor 46 is located aft of the turbine nozzle assembly 44 and is spaced axially therefrom so as to define a forward wheel cavity 58. The forward wheel cavity 58 is in fluid communication with the turbine flow path through which the hot combustion gases flow. The turbine rotor 46 includes a plurality of turbine blades 60 (one shown in FIG. 2) suitably mounted to a rotor disk 62 and radially extending into the turbine flow path. The rotor disk 62 is arranged for rotation about the centerline axis 12. An annular rotating seal member 64 is fixed to the rotor disk 60 for rotation therewith.

The rotating seal member 64 contacts the stationary seal member 56 to form a forward outer seal 66 for sealing the compressor discharge air that is bled off for cooling purposes from the hot gases in the turbine flow path. Preferably, the forward outer seal 66 is a rotating labyrinth seal that includes three thin, tooth-like projections 68, 70, 72 attached to, or integrally formed on, the rotating seal member 64. The projections 68, 70, 72 are annular members that extend radially outward toward the stationary seal member 56. The labyrinth seal 66 further includes three annular stator elements 74, 76, 78 attached to the stationary seal member 56 and positioned radially outward of and circumferentially about the projections 68, 70, 72.

These components are positioned axially so that each one of the projections 68, 70, 72 is axially aligned with a respective one of the stator elements 74, 76, 78. That is, the first projection 68 is axially aligned with the first stator element 74, the second projection 70 is axially aligned with the second stator element 76, and the third projection 72 is axially aligned with the third stator element 78. By "axially aligned," it is meant that each projection 68, 72, 74 is located along the axial direction between the forward surface and the aft surface of its corresponding stator element 74, 76, 78. The outer circumference of each projection 68, 70, 72 rotates within a small tolerance of the inner circumference of the corresponding stator element 74, 76, 78, thereby effecting sealing between the cooling air and the hot gases in the turbine flow path. The stator elements 74, 76, 78 are preferably made of a honeycomb material to reduce friction and subsequent heat generation during operation. Although FIG. 2 shows three pairs of the projections and stator elements, it should be noted that the present invention is not limited to three pairs; more or fewer than three could be used.

The turbine nozzle assembly 44 includes an accelerator 80 disposed between the conical portion 54 and the stationary seal member 56 of the inner nozzle support 48. The accelerator 80 is an annular member that defines an internal air plenum 82. As represented by arrow A in FIG. 2, compressor delivery air is fed to the plenum 82 via air holes 84 formed in the conical portion 54 of the inner nozzle support 48. This cooling air passes axially through the accelerator 80 and is discharged therefrom through a plurality of accelerator nozzles 86 formed in the aft end of the accelerator 80 for cooling high pressure turbine blades 60.

The accelerator 80 also includes a plurality of hollow tubes 88 extending radially through the air plenum 82 so as not to permit fluid communication therewith. Additional cooling air (represented by arrow B) passes radially through the hollow tubes 88 and into the chamber 90 located immediately forward of the stationary seal member 56. The source of the cooling air represented by arrow B is leakage past the engine's compressor discharge pressure (CDP) seal (not shown). This CDP cooling air is somewhat warmer than the blade cooling air delivered through the accelerator 80.

The stationary seal member 56 has a number of blocker holes 92 formed therein. The blocker holes 92 are situated so as to permit CDP cooling air in the chamber 90 to pass into the cavity 94 defined between the two aftmost projections of the seal 66, i.e., the second projection 70 and the third projection 72. Accordingly, any air flow through the seal 66 is CDP air, not the cooler blade cooling air. The cooler air can thus be fully devoted to cooling the turbine blades 60.

Figure 3:
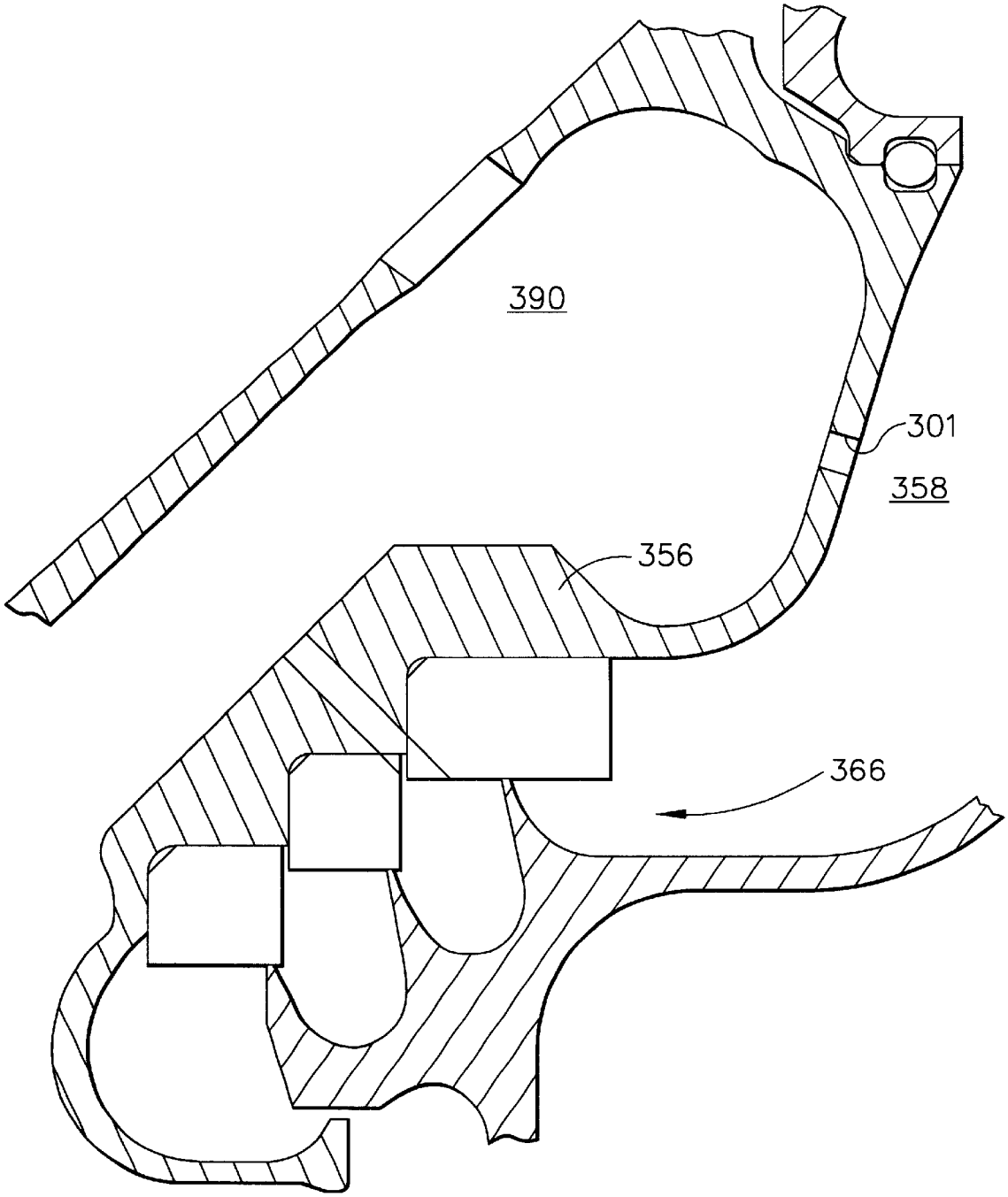
FIG. 3 (PRIOR ART)
FIG. 3 is a partial cross-sectional view of the high pressure turbine section of a prior art gas turbine engine.

As mentioned above, a flow of cooling air into the forward wheel cavity 58 is needed to purge the cavity 58 so as to prevent hot gas ingestion. This is achieved in conventional gas turbine engines (see FIG. 3) by forming a number of by-pass holes 301 in the stationary seal member 356 radially outward of the forward outer seal 366 to allow cooling air in the chamber 390 located immediately forward of the stationary seal member 356 to pass into the forward wheel cavity 358. In the present invention, however, no such by-pass holes are formed in stationary seal member 56. Instead, the aftmost or third stator element 78 is provided with a plurality of slots 96 formed in its radially innermost surface 98, i.e., the surface that contacts the rotating projection 72. The slots 96 extend from the forward surface 78*a* to the aft surface 78*b* of the third stator element 78 so as to axially traverse the projection 72. Consequently, cooling air in the cavity 94 between the second and third projections 70 and 72 is allowed to flow into and purge the forward wheel cavity 58.

Figure 4:
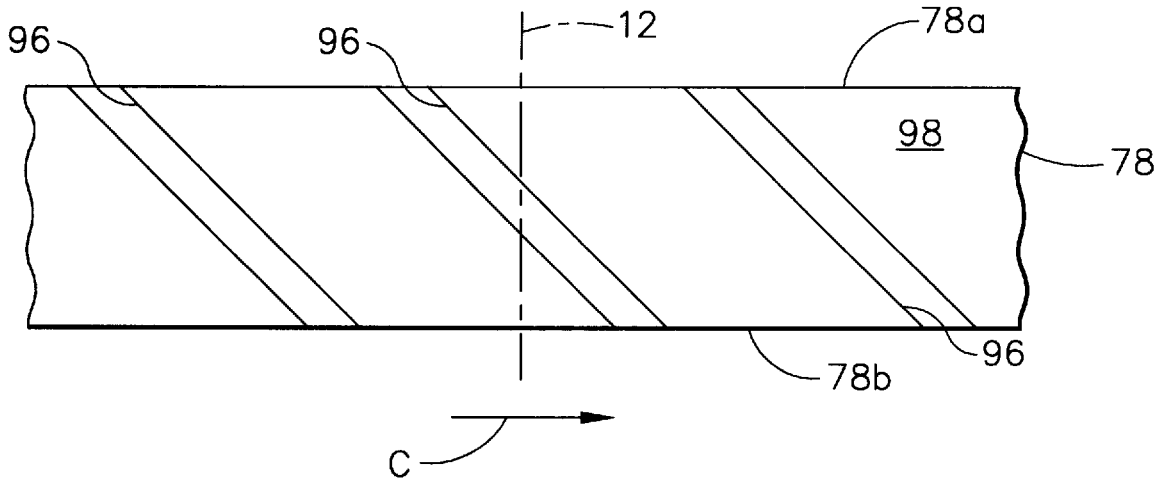
FIG. 4 is a plan view of the radially innermost surface of a stator element from the forward outer seal of the present invention.

As best seen in FIG. 4, which shows a portion of the radially innermost surface 98 of the third stator element 78, the slots 96 are angled with respect to the centerline axis 12 (that is, the slots 96 are not parallel to the axis 12). Preferably, the slots 96 are angled circumferentially in the direction of rotation of the rotating seal member 64 (represented by arrow C in FIG. 4). Thus, cooling air exiting the slots 96 will be provided with a swirl that will reduce the windage heat pickup in the forward wheel cavity 58. That is, because the entering purge air will have a velocity component in the direction of rotor rotation, the velocity differential between the rotating components and the purge air flow will be less than otherwise. Consequently, the friction between the air and the rotating components will be less, which means that less heat will be generated. The angle of the slots 96 with respect to the direction of rotation is preferably in the range of about 0–70°, and most preferably about 45 degrees or higher.

Figure 5:
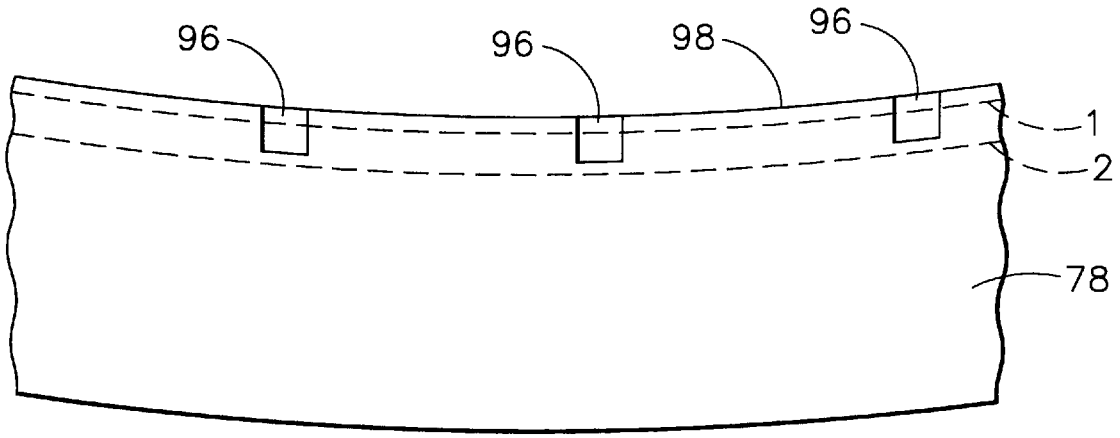
FIG. 5 is a partial end view of the stator element of FIG. 4.

Referring now to FIG. 5, it is seen that the slots 96 are preferably, although not necessarily, rectangular in cross-section. The depth and width of the slots 96 are matched to meet purge requirements with respect to the seal rub depth of the stator element 78. As used herein, the term "seal rub depth," refers to the extent the thickness of a stator element is reduced due to wear caused by rubbing with the rotating tooth-like projection. Thus, in FIG. 5, the solid lines depict the original, as made, thickness of the third stator element 78, dashed line 1 depicts the thickness at "break-in seal" (i.e., after an initial break-in period, which is the point at which an engine containing the seal would be delivered) and dashed line 2 depicts the minimum thickness at which the stator element 78 must be replaced. The depth and width of the slots 96 are selected such that the total cross-sectional area of all the slots 96 at break-in seal will be sufficient to meet the purge requirements of the forward wheel cavity 58.

Figure 6:
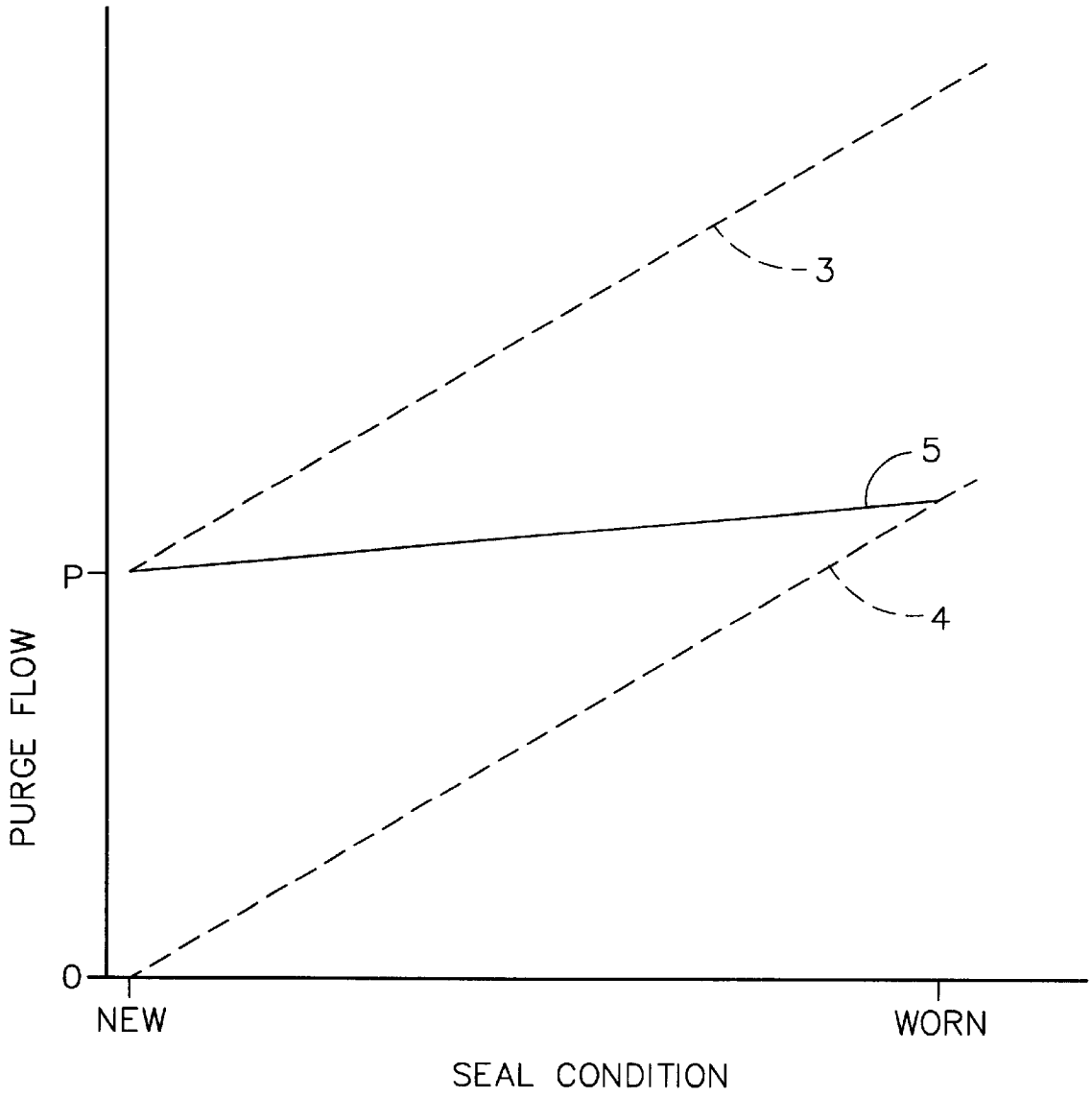
FIG. 6 is a graph showing total purge flow as a function of seal condition.

During new engine operation, the projections 68, 70, 72 will rub tightly into the stator elements 74, 76, 78 to form a tight seal. The forward wheel cavity 58 will be purged by a flow of air from the cavity 94 passing through the slots 96. Continued operation of the engine 10 will result in gradual deterioration of the seal 66, causing the clearances between the projections 68, 70, 72 and the stator elements 74, 76, 78 to open up. Consequently, more cooling air will leak through the labyrinth seal 66 into the forward wheel cavity 58. However, as the stator elements 74, 76, 78 wear down, the size of the slots 96 is constantly decreasing. So as the amount of purge air leaking through the seal 66 increases, the amount of purge air passing through the slots 96 decreases. This effect is illustrated in FIG. 6, which is a graph showing the total purge flow as a function of the seal condition. As shown in the graph, dashed line 3 represents the level of purge flow in a conventional seal and by-pass hole arrangement such as that of FIG. 3, dashed line 4 represents the level of purge flow in an arrangement having only a conventional seal, and solid line 5 represents the purge flow that results from slotted seal of the present invention.

With the conventional seal and by-pass hole arrangement of dashed line 3, the purge flow begins at the desired level P when the seal is new, but the purge flow quickly exceeds the desired level as the seal wears. This excess purge flow can be detrimental to overall engine performance. In the conventional seal only arrangement of dashed line 4, the initial purge flow is substantially below the desired level when the seal is new and only attains the desired level near the end of the wear life of the seal. This arrangement thus fails to provide an acceptable level of purge flow over much of the seal's lifetime. With the present invention represented by solid line 5, the purge flow begins at the desired level when the seal is new. However, because the size of the slots 96 decreases as the seal wears down, the purge flow level, unlike with the case of dashed line 3, increases only gradually over the life of the seal. Thus, the present invention largely avoids the problem of excess wheel cavity purge flow seen in conventional gas turbine engines, thereby improving overall engine performance.

Referring again to FIG. 5, the depth of the slots 96 is above the dashed line 2, the seal rub depth at which the stator element 78 must be replaced. Thus at some point during the operational life of the stator element 78, the slots 96 will be completely eliminated and the total purge flow into the forward wheel cavity 58 will be due to leakage through the seal 66. Alternatively, the depth of the slots 96 can be formed below the dashed line 2 so that there will always be some slot flow during the operational life of the stator element 74. Whether the slot depth is above or below the minimum seal rub depth depends on the particular purge flow requirements of the engine 10 in which the seal 66 is used.

Figure 7:
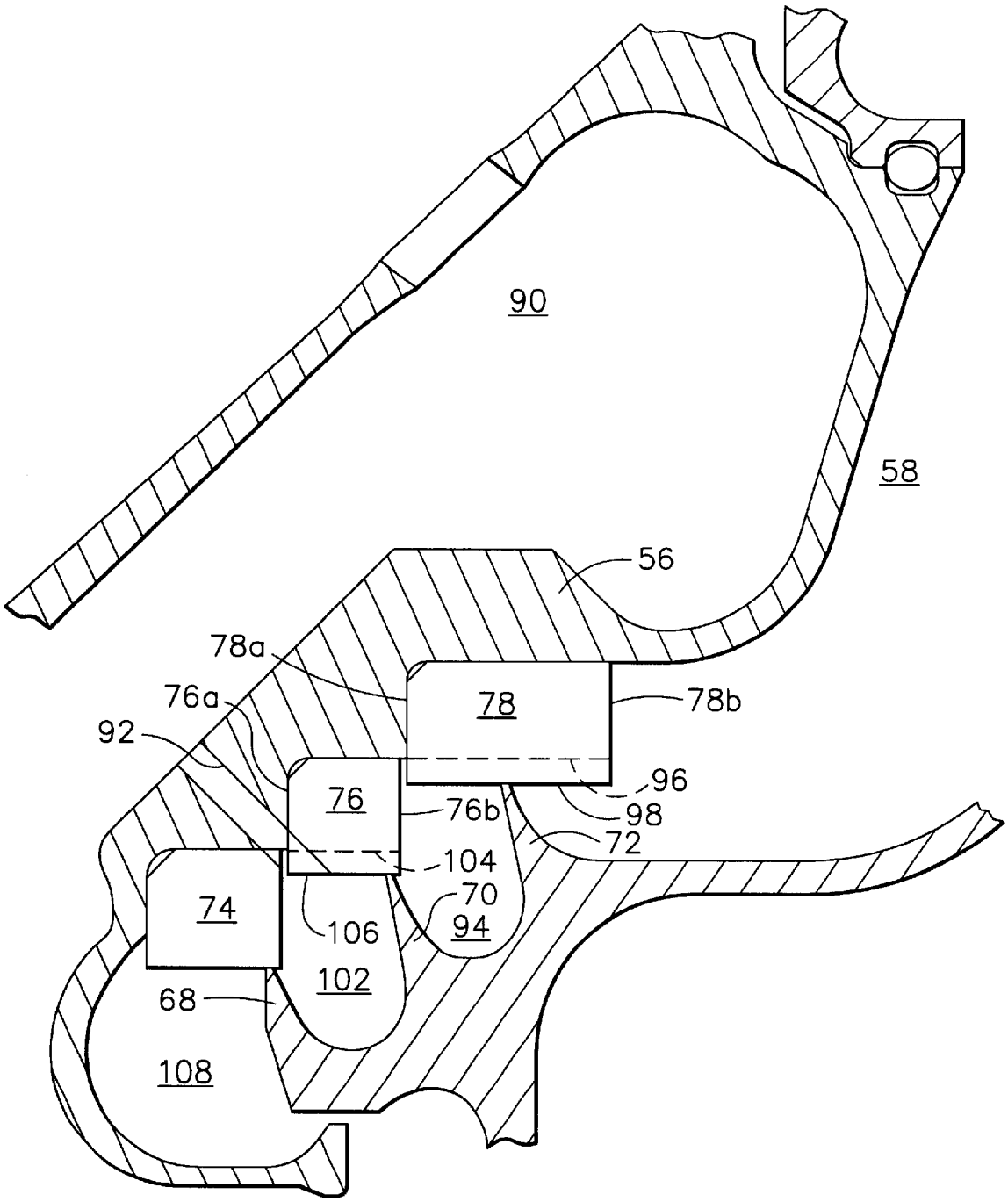
FIG. 7 is a partial cross-sectional view of the high pressure turbine section of the gas turbine engine having a second embodiment of the forward outer seal of the present invention.

Turning to FIG. 7, a second embodiment of the present invention is shown. In this embodiment, the stationary seal member 56 has a number of blocker holes 92 formed therein so as to permit CDP cooling air from the chamber 90 to pass into the cavity 102 defined between the first projection 68 and the second projection 70. In order to provide a flow of purge air from the cavity 102 to the forward wheel cavity 58, the second stator element 76 is provided with a plurality of slots 104 formed in its radially innermost surface 106, i.e., the surface that contacts the second rotating projection 70. As in the first embodiment described above, the third stator element 78 is provided with a plurality of slots 96 formed in its radially innermost surface 98. Both sets of slots 104, 96 extend from the respective forward surface 76*a*, 78*a* to the respective aft surface 76*b*, 78*b* of the respective stator element 76, 78 so as to axially traverse the respective projection 70, 72. Thus, CDP cooling air will flow from the chamber 90 through the blocker holes 92 into the cavity 102, and then through the slots 104 into the cavity 94, and finally through the slots 96 into, and thereby purging, the forward wheel cavity 58.

The slots 104 are similar to the slots 96 as described above in that they are angled with respect to the centerline axis 12, preferably circumferentially in the direction of rotation of the rotating seal member 64. And like the slots 96, the depth and width of the slots 104 are selected such that their total cross-sectional area at break-in seal will be sufficient to meet the purge requirements of the forward wheel cavity 58. Furthermore, as the second stator element 76 wears down, the size of the slots 104 will constantly decrease so that as the amount of purge air leaking through the seal 66 increases, the amount of purge air passing through the slots 104 decreases.

In yet another alternative, it is possible to have a configuration with no blocker holes. In this case, all of the stator elements would be provided with a plurality of slots formed in their radially innermost surfaces so as to allow purge air from cavity 108 (FIG. 7) to purge the wheel cavity.

The foregoing has described a forward outer seal for gas turbine engines that provides an adequate, and not excessive, flow of purge air to the forward wheel cavity over the entire span of engine operation. While specific embodiments of the present invention have been described, it will be apparent to those skilled in the art that various modifications thereto can be made without departing from the spirit and scope of the invention as defined in the appended claims.

What is claimed is:

1. A rotating seal comprising:

a rotating member arranged to rotate about an axis and having at least one annular projection extending radially outwardly therefrom; and a stator element having a first surface arranged to contact said projection, a forward facing surface, and an aft facing surface, wherein a plurality of slots are formed in said first surface, and each of said slots extend from said forward facing surface to said aft facing surface and axially traverse said projection.

2. The seal of claim 1 wherein said slots are not parallel to said axis.

3. The seal of claim 2 wherein said slots are angled circumferentially in the direction of rotation of said rotating member.

4. The seal of claim 1 wherein said stator element is an annular element positioned radially outward of and circumferentially about said projection.

5. The seal of claim 1 wherein said rotating member includes additional annular projections extending radially outwardly therefrom, and further comprising additional stator elements positioned radially outward of and circumferentially about said additional projections.

6. The seal of claim 5 wherein each one of said stator elements is attached to a stationary member.

7. The seal of claim 6 wherein said stationary member has at least one hole formed therein for feeding cooling air into a cavity defined between said first-mentioned projection and an adjacent one of said additional projections.

8. The seal of claim 5 wherein each one of said additional stator elements has a first surface arranged to contact a corresponding one of said additional projections, and at least one of said additional stator elements has at least one slot formed in its first surface, said slot axially traversing said corresponding one of said additional projections.

9. A rotating seal comprising:

a rotation member arranged to rotate about an axis and having at least one annular projection extending radially outwardly therefrom, said annular projection forming a boundary between a first fluid cavity and a second fluid cavity; and a stator element having a first surface arranged to contact said projection, a forward surface exposed to said first fluid cavity, and an aft surface exposed to said second fluid cavity, said stator element including means for allowing air to pass therethrough from said first cavity to said second cavity.

* * * * *